US005466168A

United States Patent [19]

Liebich et al.

[11] Patent Number: 5,466,168

[45] Date of Patent: Nov. 14, 1995

[54] PLUG CONNECTOR WITH SHORT-CIRCUIT BRIDGE

[75] Inventors: Ernst Liebich, Geltendorf/Hausen; Rony Van Houdenhove, München; Miroslav Smoravek, Seefeld; Richard Flieger, Stammham, all of Germany

[73] Assignee: Siemens Aktiengesellschaft, Munich, Germany

[21] Appl. No.: 219,779

[22] Filed: Mar. 30, 1994

Related U.S. Application Data

[63] Continuation of PCT/EP92/01980, filed Aug. 27, 1992.

[30] Foreign Application Priority Data

Sep. 30, 1991 [DE] Germany ..... 9112178 U

[51] Int. Cl.[6] ..... H01R 29/00

[52] U.S. Cl. ..... 439/188; 439/509

[58] Field of Search ..... 439/188, 507, 439/509, 512, 513, 723

[56] References Cited

U.S. PATENT DOCUMENTS 4,850,888 7/1989 Denlinger et al. ..... 439/188 OR
5,263,872 11/1993 Marpoe, Jr. et al. ..... 439/188 OR
5,295,846 3/1994 Sumida et al. ..... 439/188 OR

FOREIGN PATENT DOCUMENTS 0389779 10/1990 European Pat. Off. .
901056566 10/1990 Germany .
405089927 4/1993 Japan ..... 439/512 OR
2240671 8/1991 United Kingdom ..... 439/188 OR

*Primary Examiner*—Daniel W. Howell
*Assistant Examiner*—Daniel Wittels
*Attorney, Agent, or Firm*—Herbert L. Lerner; Laurence A. Greenberg

[57] ABSTRACT

A two-legged contact spring with a spring base, at least one contact leg and a U-shaped bend is provided as a short-circuit bridge for the connection of two contact elements. The contact leg is freely yielding and has a projection which contactingly rests directly at a transitional region of the contact element. Therefore, the spring work is carried out exclusively by the short-circuit bridge. The spring form and position of the contact point ensures an optimal spring action at low operating forces.

20 Claims, 5 Drawing Sheets

PLUG CONNECTOR WITH SHORT-CIRCUIT BRIDGE

CROSS-REFERENCE TO RELATED APPLICATION

This application is a continuation of International Application Serial No. PCT/EP92/01980 (now WO 90/07662), filed Aug. 27, 1992.

BACKGROUND OF THE INVENTION

Field of the Invention

The invention relates to a plug connector including a housing being made of insulating material and having contact chambers in which contact elements with a terminal region and a contact region are disposed in a row, at least one contact spring disposed in a row parallel to them, each contact spring connecting two contact elements with one another as a short-circuit bridge and having a spring base resting on the inside of an outer wall of the housing and at least one freely yielding contact leg having a projection being aimed at the contact elements as a contact point and being connected to the spring base at one end through a bend with U-shaped cross section, and a plug body being made of insulating material, being constructed with a row of contact pins or blades intended for insertion into the contact elements and being constructed with a contact breaker element made of insulating material in a row parallel thereto for each short-circuit bridge, for lifting a contact spring from the joined-together contact elements when the housing and plug body are coupled together.

German Petty Patent G 90 10 565.6 discloses a plug connector, in which contact devices are provided in a second contact chamber row in order to form a break contact in the non-coupled state of the housing and the plug body. Each of the contact devices is constructed with at least one spring leg being bent at an angle and each cooperate with at least one spring leg protruding into the second contact chamber row of the contact elements disposed in the first contact chamber row. In that known plug connector, the break contact is opened by virtue of the fact that, when the housing and the plug body are coupled together, an insulating pin of the plug body forces the spring legs of the contact devices and contact elements apart in opposite directions at the bent contact points contacting one another.

Published European Application No. 0 389 779 A2 discloses a multi-pole plug configuration with a short-circuit bridge. That bridge includes a contact spring with a freely yielding contact leg that is joined to a spring base through a U-shaped bend. The actuation of the short-circuit bridge is carried out through a contact breaker, which is introduced into the configuration from the side of the U-shaped bend and is thrust onto the entire contact leg far enough to ensure that the contact point located at the free end of the contact leg is lifted from the contact parts.

SUMMARY OF THE INVENTION

It is accordingly an object of the invention to provide a plug connector with a short-circuit bridge, which overcomes the hereinafore-mentioned disadvantages of the heretofore-known devices of this general type and which improves a spring action of the short-circuit bridge in such a plug connector.

With the foregoing and other objects in view there is provided, in accordance with the invention, a plug connector, comprising a housing being made of insulating material and having contact chambers and an outer wall with an inner surface; contact elements being disposed in the contact chambers in a row and having a terminal region, a contact region and a transitional region being formed as a contact region between the terminal region and the contact region; at least one contact spring disposed in a row parallel to the contact elements, each contact spring connecting two of the contact elements with one another as a short-circuit bridge and including a spring base resting on the inner surface of the outer wall and at least one freely yielding contact leg having a projection or boss in the form of a contact point being aimed at the contact elements, the projection resting contactingly directly on the transitional region of two of the contact elements, the contact leg having one end with a bend having a U-shaped cross section and being connected to the spring base, and the contact leg having a free end and defining a lever arm between the projection and the free end; and a plug body being made of insulating material and having a row of contact pins or contact blades to be inserted into the contact elements and a contact breaker element made of insulating material in a row parallel to the row of contact pins for each short-circuit bridge; the contact breaker element lifting a contact spring from the interconnected contact elements when the housing and the plug body are coupled together, and the contact breaker element being introduced into the housing at the free end of the contact leg and being thrust onto the lever arm, for pressing the lever arm and the free end to the side during the coupling and lifting the projection from the transitional region.

In such a plug connector, the spring work is carried out solely by the short-circuit bridge. Due to the two-legged structure of the short-circuit bridge in cooperation with the connection of the two spring legs through a U-shaped bend, a lengthening of the spring legs is brought about, which leads to a marked increase in the allowable spring travel. Since the location of the point of contact on the freely yielding contact leg can be chosen optionally, and the actuation of the short-circuit bridge is carried out by the circuit breaker element of the plug body on the free end of the contact leg, a low actuation force with a highly effective contact force is attained for the contact opening by means of the contact breaker element to be inserted. In such a plug connector, the result is accordingly improved spring action and improved tolerance compensation. The structure of the short-circuit bridge according to the invention moreover permits direct contacting at the transitional region of the contact elements between the terminal region and the contact region. The contacting thus takes place at the most advantageous point in a region with a low contact resistance. Moreover, due to this kind of direct contacting it is possible to use the contact elements which are already provided for normal use in plug connectors, for the short-circuit contacting in a geometrically identical way. In other words, the usual contact elements can be used in an unchanged manner for the short-circuit contacting as well.

In accordance with another feature of the invention, the projection of the contact leg has a U-shaped or V-shaped cross section.

In accordance with still another feature of the invention, the rear side of the transitional region, which is oriented toward the projection of the contact leg, extends in flush alignment, for instance by means of a stamping or embossing, with the rear side of the contact region of the contact element. This is especially advantageous whenever the contact element is introduced into the housing of the plug connector after the short-circuit bridge and thus slides with its rear side past the projection of the contact leg of the short-circuit bridge.

In accordance with a further feature of the invention, in order to provide a structure with good lever action that is advantageous in view of the spring action and in particular with respect to the plug-in force and the contact force, the contact leg of the contact spring is approximately twice as long as the spring base.

In accordance with an added feature of the invention, the projection of the contact leg is spaced away from the free end of the contact leg by a distance of approximately one-third of the total length of the contact leg.

In accordance with an additional feature of the invention, the contact leg of the contact spring is offset somewhat toward the spring base by means of a right-angle bend at the transition to the U-shaped bend. A right-angle bend on the contact leg increases the spacing between the contact leg and the terminal region of the contact element facing it, and provides greater security against electrical bridging.

In accordance with still a further feature of the invention, the free end of the contact leg is bent obliquely at an angle.

In accordance with yet another feature of the invention, the contact leg has a middle with a longitudinal slit extending longitudinally of the leg and beginning at the free end of the contact leg. This produces a double contact of the short-circuit bridge, with doubling of the air and creepage paths, and two contact legs are formed by means of the longitudinal slit, which rest on two contact elements.

In accordance with yet a further feature of the invention, the longitudinal slit extends beyond the U-shaped bend as far as the spring base. In this case, the end of the slit can be used as a pressure surface for pressing-in the spring base.

In accordance with yet an added feature of the invention, there is provided an additional detent spring of spring steel being mounted on the spring base and locking into place with a deployed spring tab in an opening of the outer wall of the housing. This is advantageous in order to anchor the short-circuit bridge in the housing of a plug connector, keeping in mind the very small dimensions that are possible in such contact springs.

In accordance with yet an additional feature of the invention, the spring tab is located below the spring base, laterally of the U-shaped bend. As a result, contact of the spring base over a large area can be attained, which is advantageous with a view to absorbing the forces of reaction.

In accordance with still an added feature of the invention, the spring base has two recesses formed therein in which the detent spring is secured with two bending tabs.

In accordance with again another feature of the invention, the contact spring, together with two contact elements, is disposed as a short-circuit unit in a common contact chamber of the housing. This is done with a view to providing the most compact possible construction and disposition of a short-circuit contacting means including two contact elements and one short-circuit bridge.

In accordance with again a further feature of the invention, for positional fixation of the contact spring, the outer wall of the housing is constructed with two lateral guide grooves for the spring base, and the contact chamber is constructed with a centrally disposed support rib. An adequately secure positional fixation of the short-circuit bridge can thus be achieved, with a very closely spaced configuration and at little expense for fixation means for the short-circuit bridge.

In accordance with again an added feature of the invention, the housing has a terminal side, and the U-shaped bend of the contact spring extends beyond the contact chamber on the terminal side.

In accordance with again an additional feature of the invention, there is provided a covering made of insulating material for protecting the U-shaped bend from the outside on at least one side.

In accordance with a concomitant feature of the invention, the covering includes an angle bracket having an L-shaped cross section and being secured to the housing, such as in detent fashion.

Other features which are considered as characteristic for the invention are set forth in the appended claims.

Although the invention is illustrated and described herein as embodied in a plug connector with a short-circuit bridge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
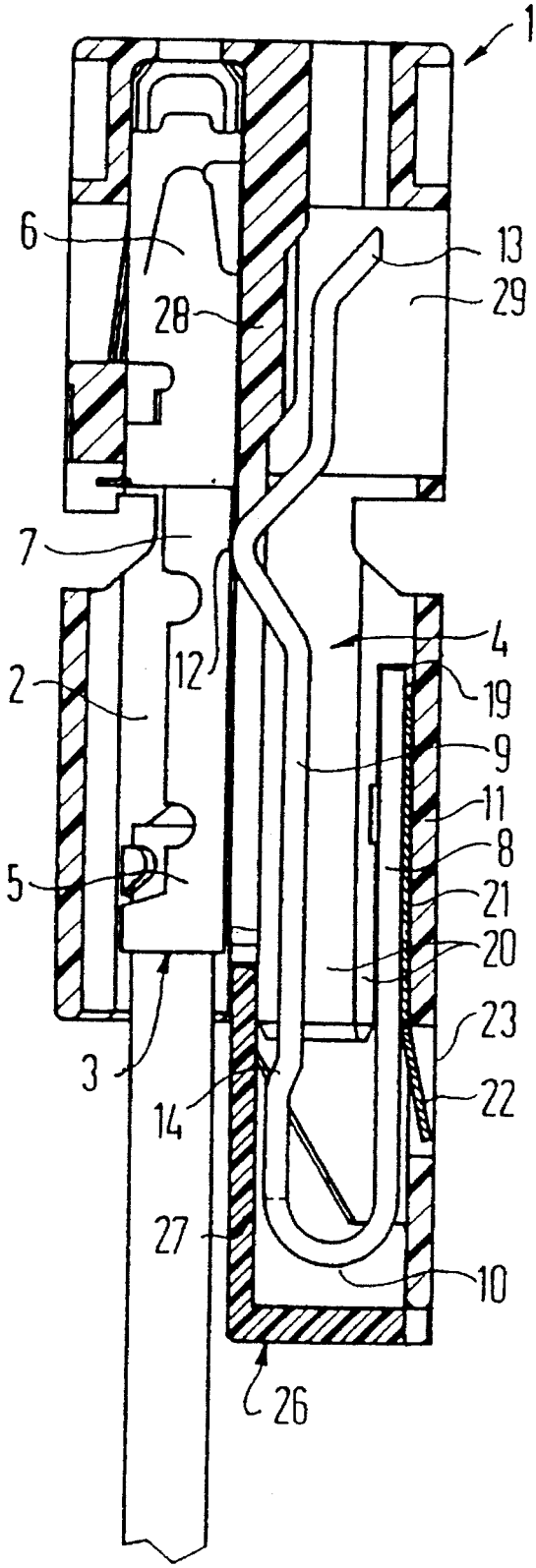
FIG. 1 is a fragmentary, diagrammatic, sectional view of a plug connector, which is taken through a contact chamber.

Referring now to the figures of the drawing in detail and first, particularly, to FIG. 1 thereof, there is seen a plug connector which includes a housing 1 of insulating material that has a plurality of contact chambers 2 located side by side, for contact elements 3 and contact springs 4. In each contact chamber 2, there are two contact elements 3 and one contact spring 4, which joins the two contact elements together as a short-circuit bridge. In this way, short-circuit units disposed in rows are formed in modular fashion, or in other words without any loss of time for dividing them. In this configuration, in rows between two short-circuit units, standard contact chambers disposed in two pairs, without a short-circuit contact, may also be provided.

The contact elements 3 are disposed in a first row inside the contact chambers 2 and include the usual contact elements for such plug connectors, with a terminal region 5, a contact region 6 and a transitional region 7 between the terminal and contact regions 5, 6. The contact springs 4 for the short-circuit bridges are disposed in a row parallel to the first row and are constructed and disposed in a manner to be described in further detail below.

Figure 3:
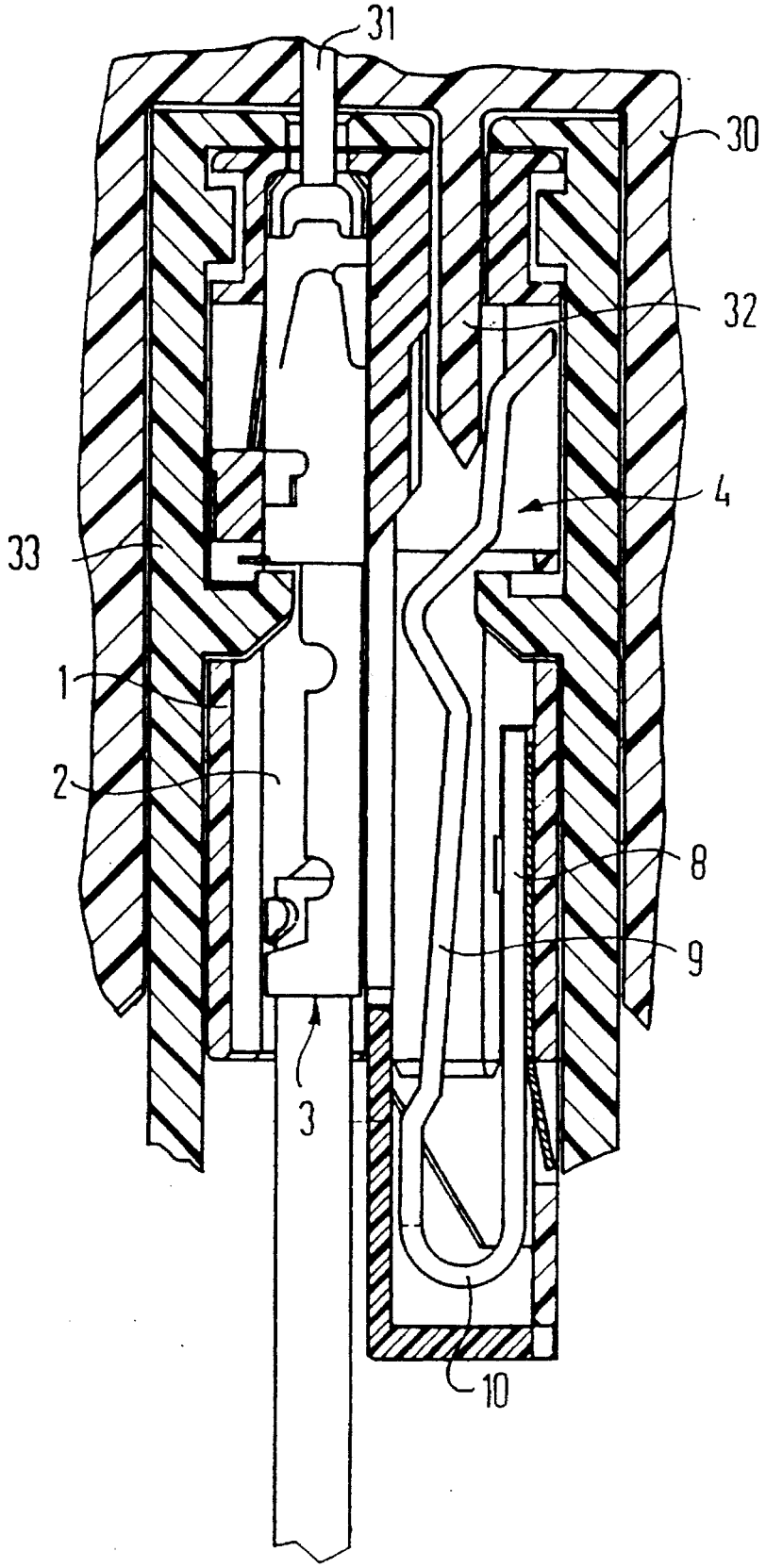
FIG. 3 is a view similar to FIG. 1 of a plug connector in a coupled state.

As is shown in FIG. 3, the plug connector also includes a plug body 30 made of insulating material, which is constructed with a row of contact pins or blades 31 that are intended for insertion into the contact elements 3, and which is constructed in a row parallel to it with one contact breaker element 32 made of insulating material for each short-circuit bridge 4. When the housing 1 and the plug body 30 are coupled together, this breaker element 32 lifts a contact spring 4 from the joined-together contact elements 3. In the plug connector shown in FIG. 3, the housing 1 is also surrounded by an outer housing 33 of insulating material.

In the plug connector of the invention, the short-circuit bridges each include one two-legged contact spring 4 with a spring base 8 and at least one contact leg 9 having a bend 10 with a U-shaped cross section at one end that is joined to the spring base 8. The spring base 8 is supported on an inner surface of an outer wall 11 of the housing 1. The contact spring 9 can yield freely and is provided with a projection or boss 12 as a contact point, that is directed at the contact elements 3, is constructed to be U or V-shaped in cross section and rests directly and contactingly on the transitional region 7 of the contact elements 3. To that end, this transitional region 7 is suitably constructed as a contact point and the rear side of the transitional region 7, toward the projection 12 of the contact leg 9, extends in a flush alignment with the rear side of the contact region 6 of a contact element 3, through the use of a stamping or embossing.

Figure 6:
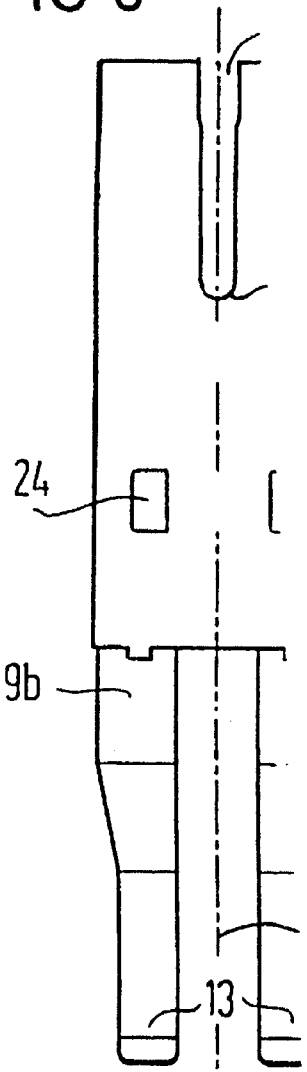
FIGS. 4, 5 and 6 are elevational views of a short-circuit bridge.
Figure 4:
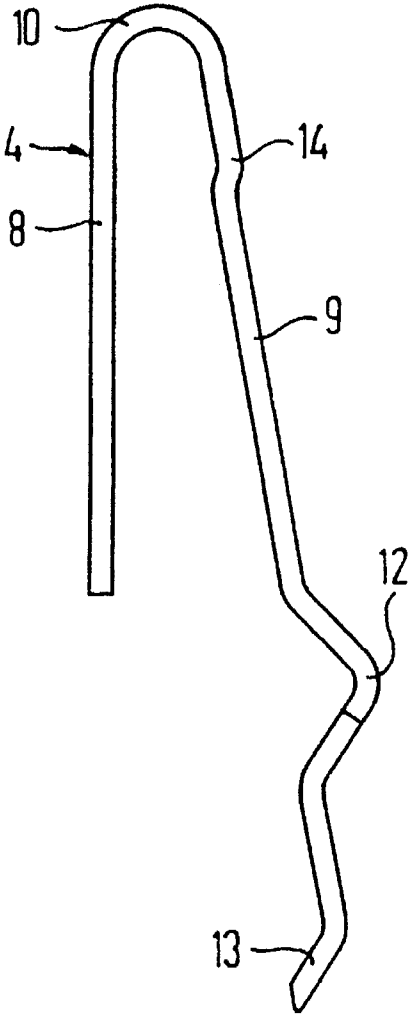
Figure 5:
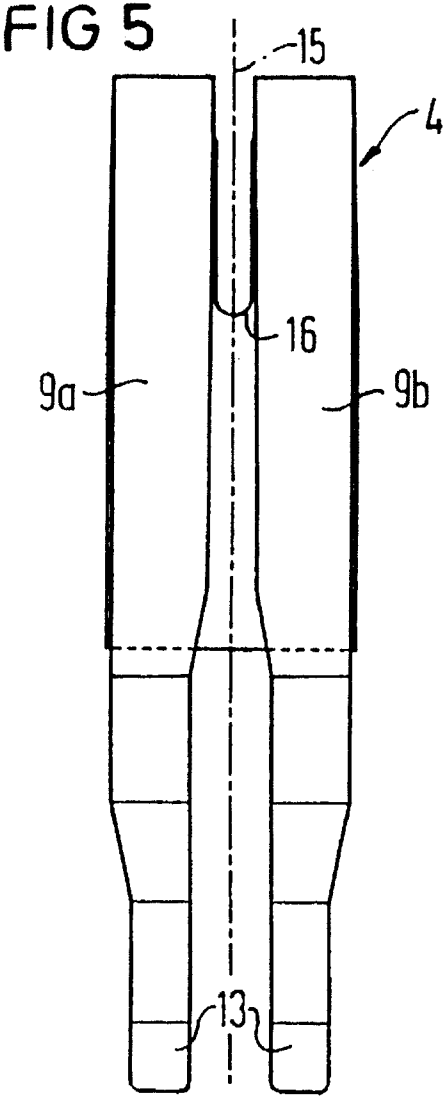

As is seen in FIGS. 1 and 4, the projection 12 is located approximately one-third of the total length of the contact leg away from a free end 13 thereof, and the contact leg 9 is approximately twice as long as the spring base 8. Moreover, the contact leg 9, which is bent obliquely at an angle on its free end 13 for accommodating the contact breaker element 32, is offset somewhat in the direction of the spring base 8 by a right-angle bend 14 at the transition to the U-shaped bend 10. As is seen in FIGS. 5 and 6, in the middle of the contact leg 9, or in other words in a symmetrical configuration, the contact leg is provided with a longitudinal slit 15 that extends longitudinally of the leg and begins at the free end 13 thereof. This slit 15 forms two parallel contact leg portions 9*a*, 9*b* resting on two contact elements 3, and extends beyond the U-shaped bend 10 as far as the spring base 8.

Figure 2:
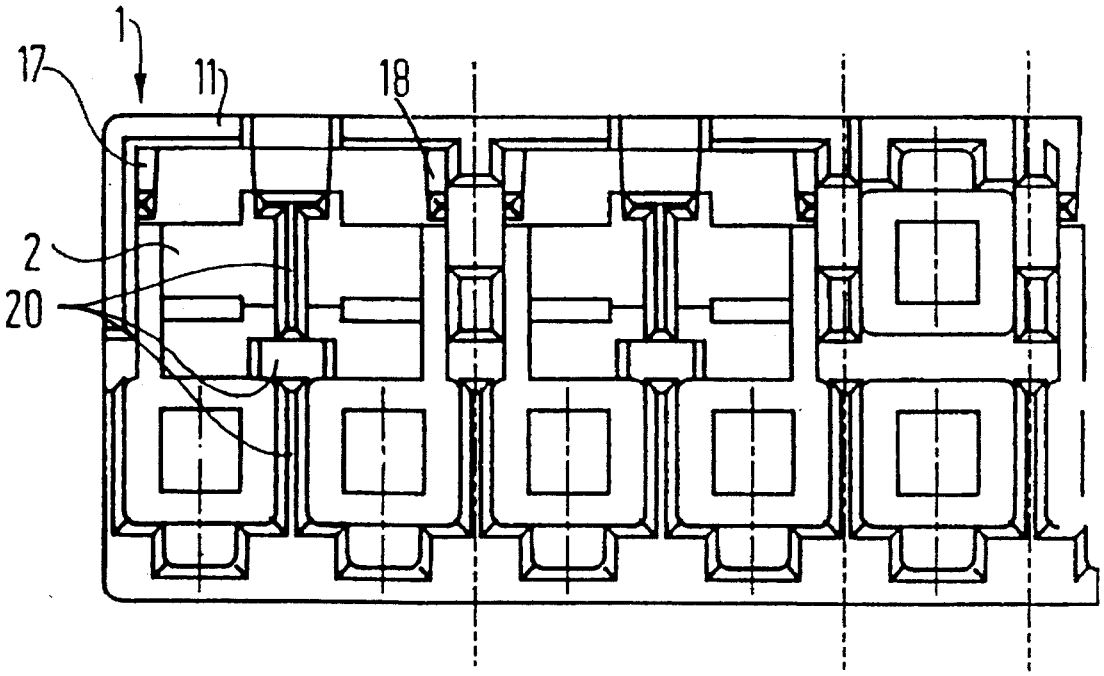
FIG. 2 is a plan view of a terminal and assembly side of a plug connector without contacts.
Figure 7:
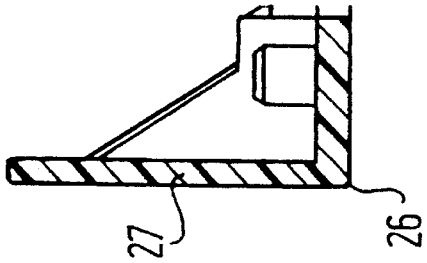
FIGS. 7, 8 and 9 are elevational views of a covering intended for the short-circuit bridge.
Figure 8:
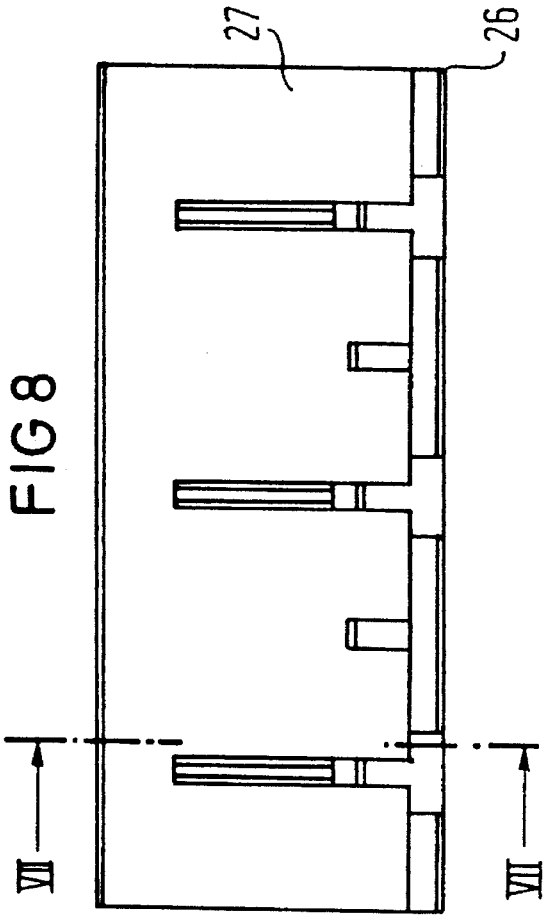
Figure 9:
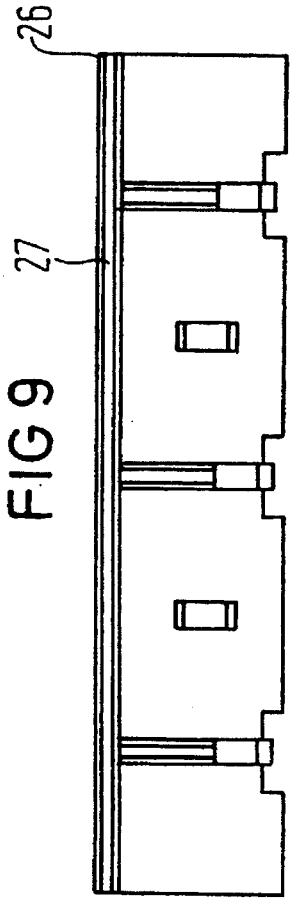

As is seen in FIGS. 1 and 2, a surface of the slit end located between the contact leg portions 9*a*, 9*b* serves as a pressure surface 16 for pressing the spring base 8 into two lateral guide grooves 17, 18 on the inner surface of the outer wall 11 of the housing 1 as far as a stop 19, which is formed on a double-T-shaped support rib 20 disposed centrally in a contact chamber 2. In order to provide further positional fixation of the contact spring 4, an additional detent spring 21 of spring steel is mounted on the spring base 8. Through the use of a deployed spring tab 22, the detent spring 21 locks in detent fashion into an opening 23 in the outer wall 11 of the housing 1. To that end, the spring base 8 is provided with two recesses 24, 25 seen in FIG. 6, in which the detent spring 21 is secured by two bending tabs. The spring tab 22 is located under the spring base 8, laterally of the U-shaped bend 10. Due to the "extension" of the contact spring 4 by the U-shaped bend 10, the contact spring extends beyond the contact chamber 2, on the terminal side of the housing 1. In that region, an L-shaped angle bracket 26 of insulating material, which is shown in FIGS. 7–9, is provided as a protecting covering on the housing and is secured to the housing 1, for instance by detent means. A long leg 27 of the covering 26 has an outer surface which forms an aid to assembly, that is it helps to introduce a contact element 3 into the contact chamber 2. On the opposite side of the contact spring 4, that is in the region of the free end 13 of the contact leg portions 9*a*, 9*b*, a support wall 28 for the contact breaker element 32 is also provided in the contact chamber 2. This wall 28 extends to near the projection 12. The outer wall 11 of the housing is moreover provided with a recess 29, that is open toward the outside, for the free spring end 13 of the contact leg portions being pressed to the side when the housing and the plug are coupled together.

We claim:

1. A plug connector, comprising:

a housing being made of insulating material and having contact chambers and an outer wall with an inner surface; contact elements being disposed in said contact chambers in a row and having a terminal region, a contact region and a transitional region being formed as a contact region between said terminal region and said contact region; at least one contact spring disposed in a row parallel to said contact elements, each contact spring connecting two of said contact elements with one another as a short-circuit bridge and including a spring base resting on said inner surface of said outer wall and at least one freely yielding contact leg having a projection in the form of a contact point being aimed at said contact elements, said projection resting contactingly directly on said transitional region of two of said contact elements, said contact leg having one end with a bend having a U-shaped cross section and being connected to said spring base, and said contact leg having a free end and defining a lever arm between said projection and said free end; and a plug body being made of insulating material and having a row of contact pins or contact blades to be inserted into said contact elements and a contact breaker element made of insulating material in a row parallel to said row of contact pins for each short-circuit bridge;

said contact breaker element lifting a contact spring from said interconnected contact elements when said housing and said plug body are coupled together, and said contact breaker element being introduced into said housing at said free end of said contact leg and being thrust onto said lever arm at a point forward of said contact point, for pressing said lever arm and said free end to the side during the coupling and lifting said projection from said transitional region.

2. The plug connector according to claim 1, wherein said projection of said contact leg has a U-shaped or V-shaped cross section.

3. The plug connector according to claim 1, wherein said transitional region has a rear side facing toward said projection of said contact leg, said contact region has a rear side facing toward said contact leg, and said rear side of said transitional region extends in flush alignment with said rear side of said contact region.

4. The plug connector according to claim 3, wherein said rear side of said transitional region extends in flush alignment with said rear side of said contact region by means of a stamping.

5. The plug connector according to claim 1, wherein said contact leg is approximately twice as long as said spring base.

6. The plug connector according to claim 1, wherein said contact leg is offset toward said spring base by a right-angle bend at a transition to said U-shaped bend.

7. The plug connector according to claim 1, wherein said contact leg has a given total length, and said projection of said contact leg is spaced away from said free end of said contact leg by a distance of approximately one-third of said given total length.

8. The plug connector according to claim 1, wherein said free end of said contact leg is bent obliquely at an angle.

9. The plug connector according to claim 1, wherein said contact leg has a middle with a longitudinal slit formed therein extending longitudinally of said contact leg and beginning at said free end of said contact leg.

10. The plug connector according to claim 9, wherein said longitudinal slit extends beyond said U-shaped bend as far as said spring base.

11. The plug connector according to claim 1, including an additional detent spring being made of spring steel, being mounted on said spring base and having a spring tab locking into place in an opening formed in said outer wall of said housing.

12. The plug connector according to claim 11, wherein said spring tab is disposed below said spring base, laterally of said U-shaped bend.

13. The plug connector according to claim 11, wherein said spring base has two recesses formed therein in which said detent spring is secured with two bending tabs.

14. The plug connector according to claim 1, wherein said contact spring together with two of said contact elements are disposed as a short-circuit unit in one of said contact chambers of said housing.

15. The plug connector according to claim 14, wherein said outer wall of said housing has two lateral guide grooves for said spring base and said contact chamber has a centrally disposed support rib, for positional fixation of said contact spring.

16. The plug connector according to claim 1, wherein said housing has a terminal side, and said U-shaped bend of said contact spring extends beyond said contact chamber on said terminal side.

17. The plug connector according to claim 16, including a covering made of insulating material for protecting said U-shaped bend from the outside on at least one side.

18. The plug connector according to claim 17, wherein said covering includes an angle bracket having an L-shaped cross section and being secured to said housing.

19. The plug connector according to claim 18, wherein said angle bracket is secured to said housing in detent fashion.

20. In a plug connector of the type having:

a housing made of insulating material and having contact chambers and an outer wall with an inner surface;

contact elements disposed in said contact chambers in a row and having a terminal region, a contact region and a transitional region formed as a contact region between said terminal region and said contact region;

at least one contact spring disposed in a row parallel to said contact elements, each contact spring connecting two of said contact elements with one another as a short-circuit bridge and including a spring base resting on said inner surface of said outer wall and at least one freely yielding contact leg having a projection in the form of a contact point being aimed at said contact elements, said contact leg having one end with a bend having a U-shaped cross section and being connected to said spring base; and a plug body made of insulating material and having a row of contact pins or contact blades to be inserted into said contact elements and a contact breaker element made of insulating material in a row parallel to said row of contact pins for each short-circuit bridge; and said contact breaker element lifting a contact spring from said interconnected contact elements when said housing and said plug body are coupled together;

the improvement which comprises:

said projection resting contactingly directly on said transitional region of two of said contact elements;

said contact leg having a free end and defining a lever arm between said projection and said free end spaced forwardly of said contact point; and said contact breaker element being introduced into said housing at said free end of said contact leg and being thrust onto said lever arm, for pressing said lever arm and said free end to the side during the coupling and lifting said projection from said transitional region by the intermediary of said lever arm.

* * * * *